US007284288B2

(12) United States Patent
Cheng

(10) Patent No.: US 7,284,288 B2
(45) Date of Patent: Oct. 23, 2007

(54) STRUCTURE OF A MOVING JOINT OF A FOLDING BABY BED WITH MESHES

(76) Inventor: Pao-Hsien Cheng, No. 139, Jen Yi 1st Street, Jen Te Hsiang, Tainan Hsien (TW)

( * ) Notice: Subject to any disclaimer, the term of this patent is extended or adjusted under 35 U.S.C. 154(b) by 5 days.

(21) Appl. No.: 11/353,055

(22) Filed: Feb. 14, 2006

(65) Prior Publication Data

US 2007/0186344 A1 Aug. 16, 2007

(51) Int. Cl.
*F16C 11/10* (2006.01)
*A47D 13/06* (2006.01)

(52) U.S. Cl. ..... 5/98.1; 5/99.1; 403/102

(58) Field of Classification Search ..... 5/98.1, 5/99.1; 403/102, 103
See application file for complete search history.

(56) References Cited

U.S. PATENT DOCUMENTS 5,745,954 A * 5/1998 Shogan et al. ..... 16/343
5,761,755 A * 6/1998 Huang ..... 5/99.1
5,781,944 A * 7/1998 Huang ..... 5/99.1
6,223,366 B1 * 5/2001 Cheng ..... 5/99.1
6,363,550 B1 * 4/2002 Wang ..... 5/99.1

* cited by examiner

*Primary Examiner*—Michael Trettel
(74) *Attorney, Agent, or Firm*—Rosenberg, Klein & Lee

(57) ABSTRACT

A moving joint of a folding baby bed is pivoted to two connecting rods, and includes a support part, a pressing member, and two stopping members; the support part has two lateral plates, and a curved slot on each lateral plate; the pressing member is movable to and from in and connected to the support part, and has a protrusion on each side; while the connecting rods are being pivoted, the connecting rods will come into contact with the protrusions to cause pivotal motion of the pressing member; the stopping members together are pivoted to a pivotal rod to form a V shape, which pivotal rod is passed through the curved slots of the lateral plates at two ends; the stopping members are subjected to an elastic position-restoring force; the connecting rods can be pivoted to fold the bed without hindrance after the pressing member has been pressed one time.

5 Claims, 6 Drawing Sheets

STRUCTURE OF A MOVING JOINT OF A FOLDING BABY BED WITH MESHES

BACKGROUND OF THE INVENTION

1. Field of the Invention

The present invention relates to a moving joint of a folding baby bed with meshes, more particularly one, which includes a pressing member to be pressed for making the baby bed foldable, and which is structured in such a way that while one of a pair of connecting rods in horizontal position is pivoted to fold the baby bed, the pressing member will be forced to tilt to one side so as not to hinder pivotal motion of the other one of the connecting rods.

2. Brief Description of the Prior Art

Referring to FIG. 6, a currently existing folding baby bed with meshes has a moving joint 9, and two connecting tubes 91 on each of upper ends of four sides thereof, which two connecting tubes 91 are pivotally connected to the moving joint 9; each of the connecting tubes 91 has two opposed through holes 911 on an inward end, and a V-shaped elastic piece 93, which has two protruding buttons 931, is held in the inward end with two apart free ends thereof projecting from the inward end of the connecting tube 91, and with the protruding buttons 931 sticking out through respective ones of the through holes 911.

Each of the moving joints 9 includes a main part 92, and a sliding bock 94. The main part 92 has an inverted U shaped section, a gap 921 on each of two ends of an upper side thereof, two opposed round connecting holes 923 on its lateral plate portions respectively, and a receiving space 922 on a middle of a lower end of each of the lateral plate portions. The sliding block 94 has an oval hole 941, an upper tapering space 942 in the shape of the space inside a "V", and a holding space 943 therein. The sliding block 94 is held in the receiving spaces 922, and a fixing element 95 is passed through the oval hole 941 and securely held in the round connecting holes 923 of the main part 92 at two ends thereof, and a spring 96 is held in the holding space 943 with an upper end thereof being pressed against the fixing element 95.

The connecting rods 2 are pivotally connected to two ends of the main part 92 respectively, near to the gaps 921, such that the protruding buttons 931 of the V-shaped elastic pieces 93 will stick through corresponding holes (not numbered) formed on the lateral plate portions of the main part 92 to prevent the connecting rods 91 from pivoting on the main part 92 after the baby bed is stretched with the connecting rods 91 in a horizontal position. Furthermore, the V-shaped elastic pieces 93 will be held in the upper tapering space 942 of the sliding block 94 when the connecting rods 91 in the horizontal in-use position. Therefore, when the sliding block 94 is pressed so as to move to an upper position, it will be pressed against and compress the elastic pieces 931 to separate the protruding buttons 931 from the holes of the lateral plate portions of the main part 92; thus, the connecting rods 91 can be pivoted on the main part 92 of the joint 9 for folding the baby bed.

The above moving joint structure has a disadvantage: the user has to keep pressing the sliding block 94 until both of the connecting rods 91 are pivoted to the not-in-use position, otherwise the sliding block 94 will return to its original position, and hinder pivotal motion of that one of the connecting rods 91 that hasn't already been pivoted; or alternatively, he can press the sliding block 94 two times, at each of said two pressing actions one of the connecting rods 91 is pivoted; therefore, it is possible for the user to forget to keep the sliding block 94 in its upper position, and try to pivot the latter one of connecting rods 91 by means of exerting a lot of force, thus causing wear and damage to the connecting rods and the moving joint.

SUMMARY OF THE INVENTION

It is a main object of the invention to provide an improvement on a moving joint of a folding baby bed with meshes, which moving joint only has to be pressed one time in order to be able to succeed in pivoting both connected rods pivoted thereto to fold the baby bed.

The moving joint of the present invention is pivoted to two connecting rods at two ends, and includes a support part, a pressing member, and two stopping members; the support part has two lateral plates, a space between the lateral plates, and a curved slot on each lateral plate; the pressing member is movable to and from in and connected to the support part, and has a protruding portion on each of two sides; while the connecting rods are being pivoted, the connecting rods will come into contact with the protruding portions to cause pivotal motion of the pressing member; the stopping members together are pivoted to a pivotal rod to form a V shape, which pivotal rod is passed through the curved slots of the lateral plates at two ends; the stopping members are subjected to an elastic position-restoring force.

Therefore, after the pressing member is pressed, pivotal motion of the connecting rods to an upright not-in-use position is allowed, and one of the connecting rods will get into contact with the corresponding protruding portion on one side of the pressing member during its pivotal motion, thus making the pressing member and the stopping members tilt to one side with the pivotal rod being displaced to tail ends of the curved guide slots. Consequently, the other one of the stopping members can't possibly hinder the pivotal motion of the corresponding connecting rod.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
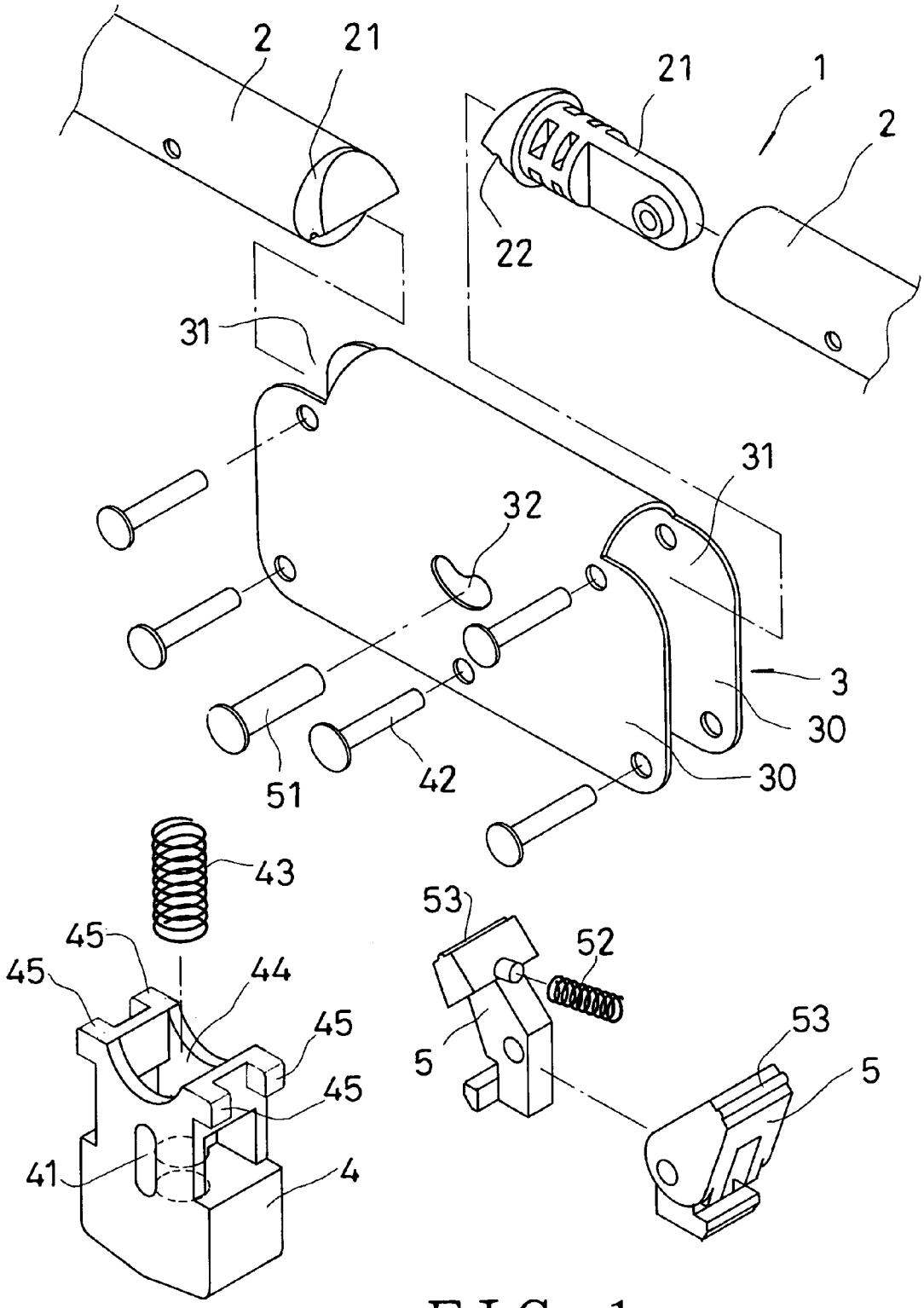
FIG. 1 is an exploded perspective view of the present invention.
Figure 2:
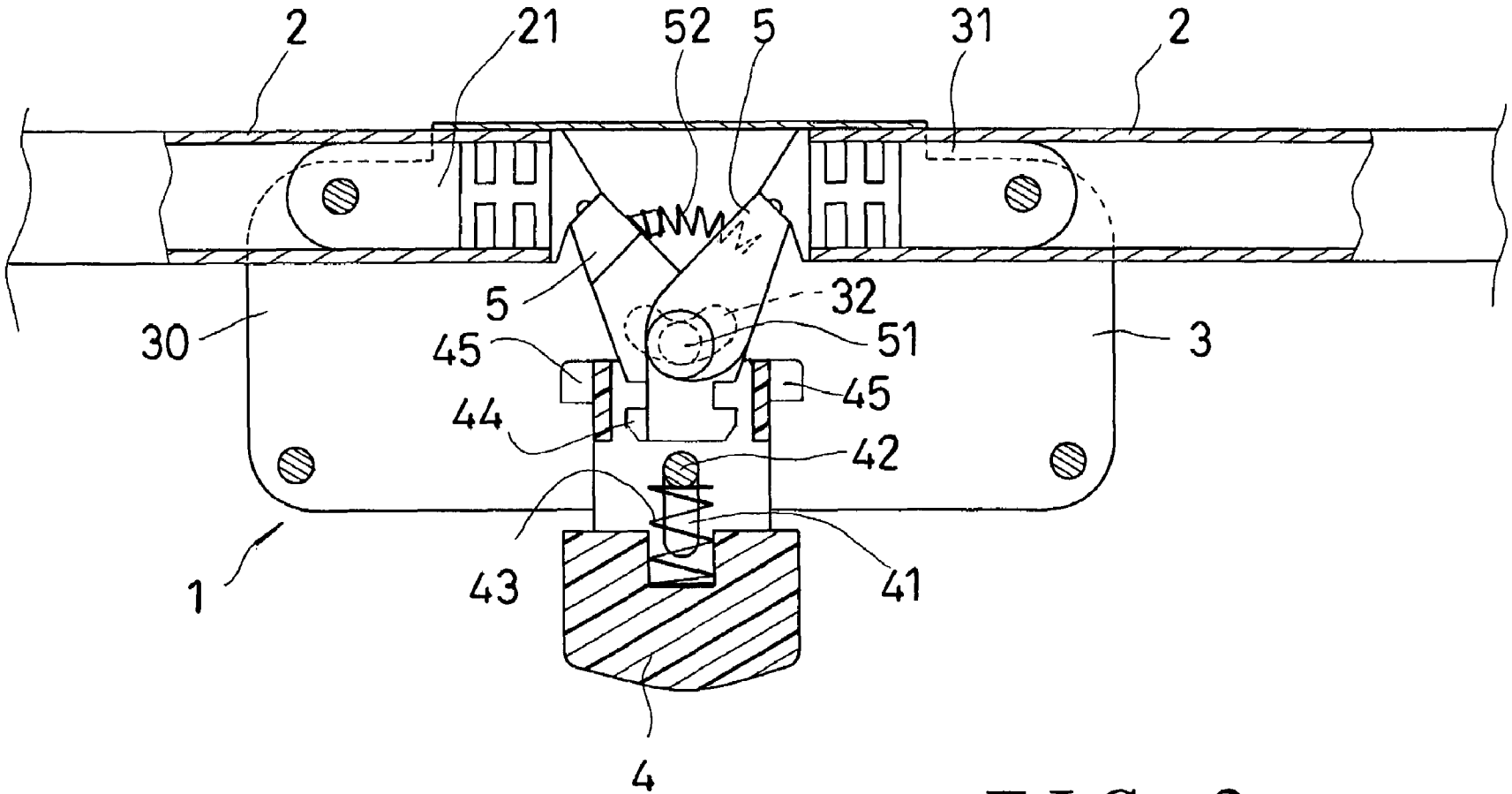
FIG. 2 is a sectional view of the present invention, with the connecting rods in the horizontal in-use position.

Referring to FIGS. 1 to 5, a preferred embodiment of a moving joint 1 of a folding baby bed with meshes includes a main support part 3, a pressing member 4, and two stopping members 5. And, two connecting rods 2 of the folding baby bed are pivoted to the joining mechanism 1.

The main support part 3 is shaped in such a way as to have an inverted U shaped cross-section, having two opposed lateral plates 30, an upper intermediate portion, gaps 31 next to two ends of the upper intermediate portion, a holding space between the lateral plates 30, and a curved guide slot 32 on each of the lateral plates 30.

The connecting rods 2 are positioned between and pivoted to the opposed lateral plates 30 of the main support part 3 at inward ends thereof such that they can be angularly displaced from a horizontal position to a substantially upright position to fold the baby bed, in which upright position the connecting rods 2 lean against two ends of the main support part 3.

The pressing member 4 has a slot 41, and it is up and down movably held in the holding space of the main support part 3 with a fixed pin 42 being passed through the slot 41 thereof and passed through and secured to the lateral plates 30 of the main support part 3. A restoring spring 43 is used for biasing the pressing member 4 downwards, which restoring spring 43 touches the fixed pin 42 and the pressing member 4 at two ends thereof. The pressing member 4 has a holding room 44, and a protruding portion 45 on each of two lateral sides thereof that face in the opposite directions; each protruding portion 45 can include two protruding blocks. While one of the connecting rods 2 is being pivoted from a horizontal position to an upright one, an inward end of said connecting rod 2 will be pressed against the corresponding protruding portion 45 to tilt the pressing member 4 to one side. Furthermore, if a person tries to pivot the connecting rods 2 from the horizontal in-use position towards the upright stored position while pressing the pressing member 4 to compress the restoring spring 43, the inward ends of the connecting rods 2 will be pressed against and supported on the protruding portions 45 of the pressing member 4; a person is allowed to force to the pressing member 4 return to its non-pressed lower position by means of pivoting the connecting rods 2.

The stopping members 5 are held between the lateral plates 30 of the main support part 3, with lower ends being held in the holding room 44 of the pressing member 4, and they together are pivoted to a common pivotal rod 51, which is passed through the curved guide slots 32 at two ends; thus, the stopping members 5 together form a V shape, defining an angle between them. Further, an elastic element 52 is positioned between free upper ends of the stopping members 5 for biasing the free upper ends of the stopping members 5 away from each other. Therefore, when the baby bed is in the stretched position, the inward ends of the connecting rods 2 will be propped on respective ones of the stopping members 5, and the connecting rods 2 are prevented from being accidentally pivoted to the upright stored position.

Figure 3:
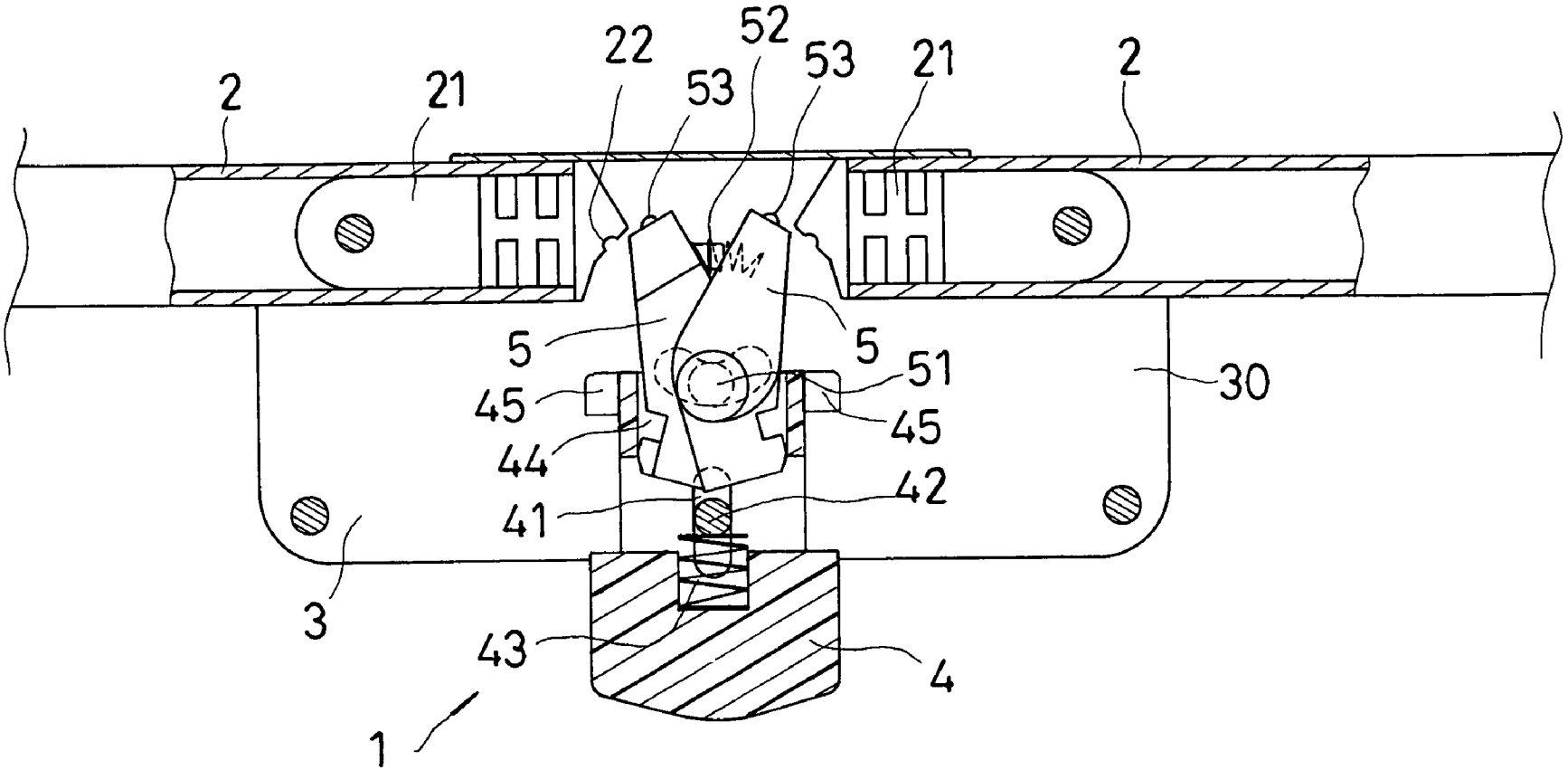
FIG. 3 is a sectional view of the present invention, with the pressing member in the pressed position.
Figure 4:
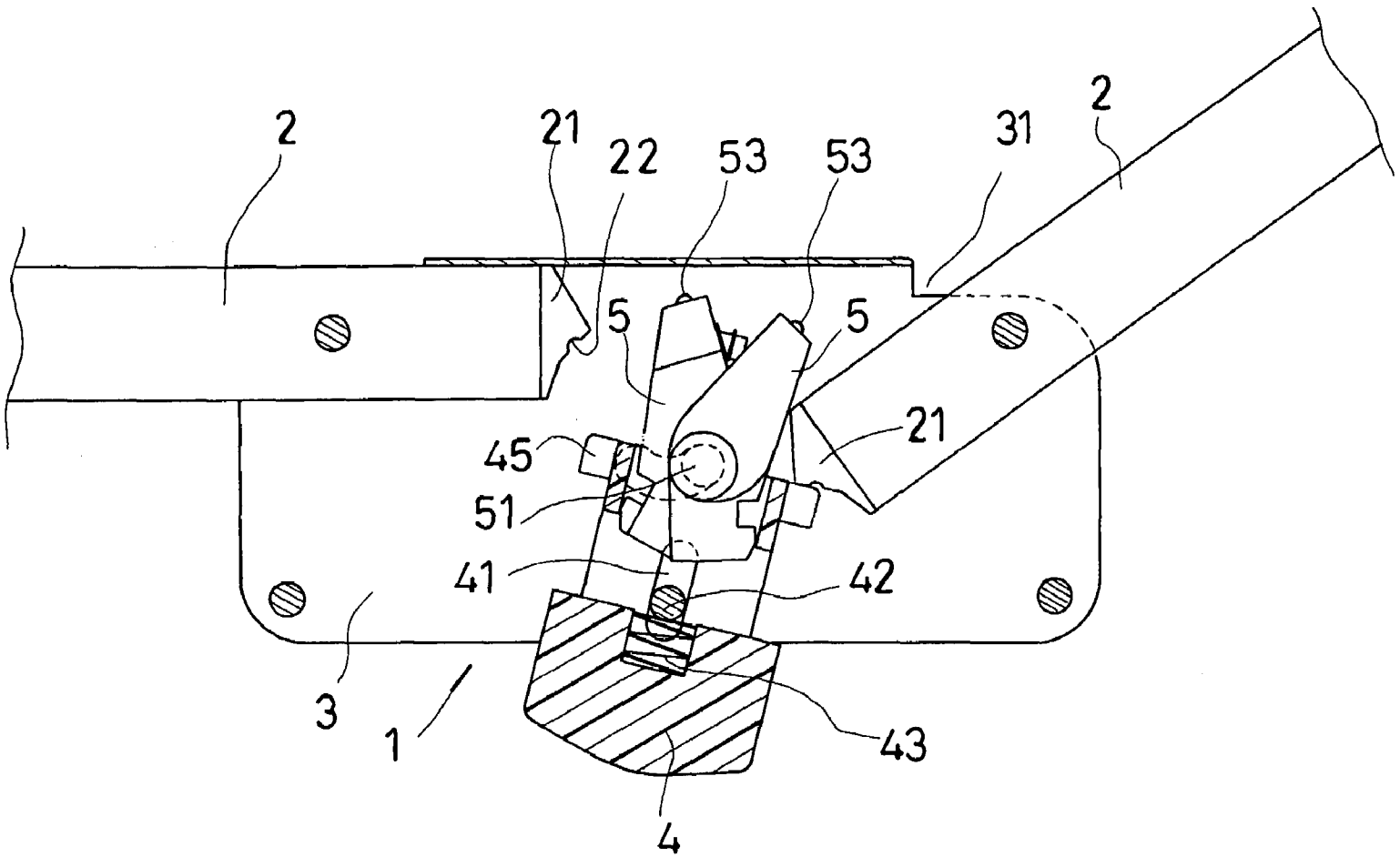
FIG. 4 is a sectional view of the present invention, with one of the connecting rod being pivoted towards the upright not-in-se position.
Figure 5:
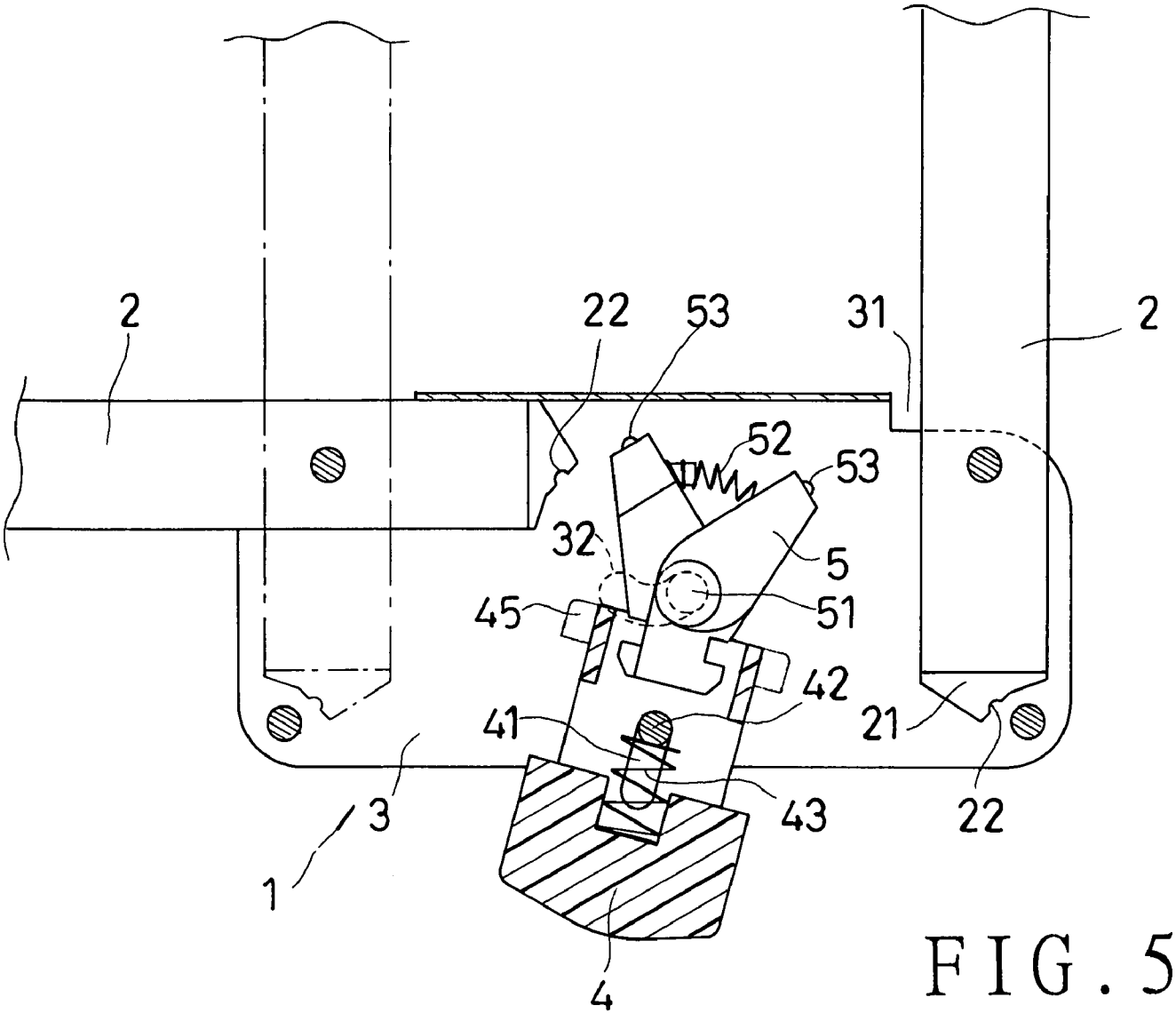
FIG. 5 is a sectional view of the present invention, with the connecting rods in the upright not-in-se position.
Figure 6:
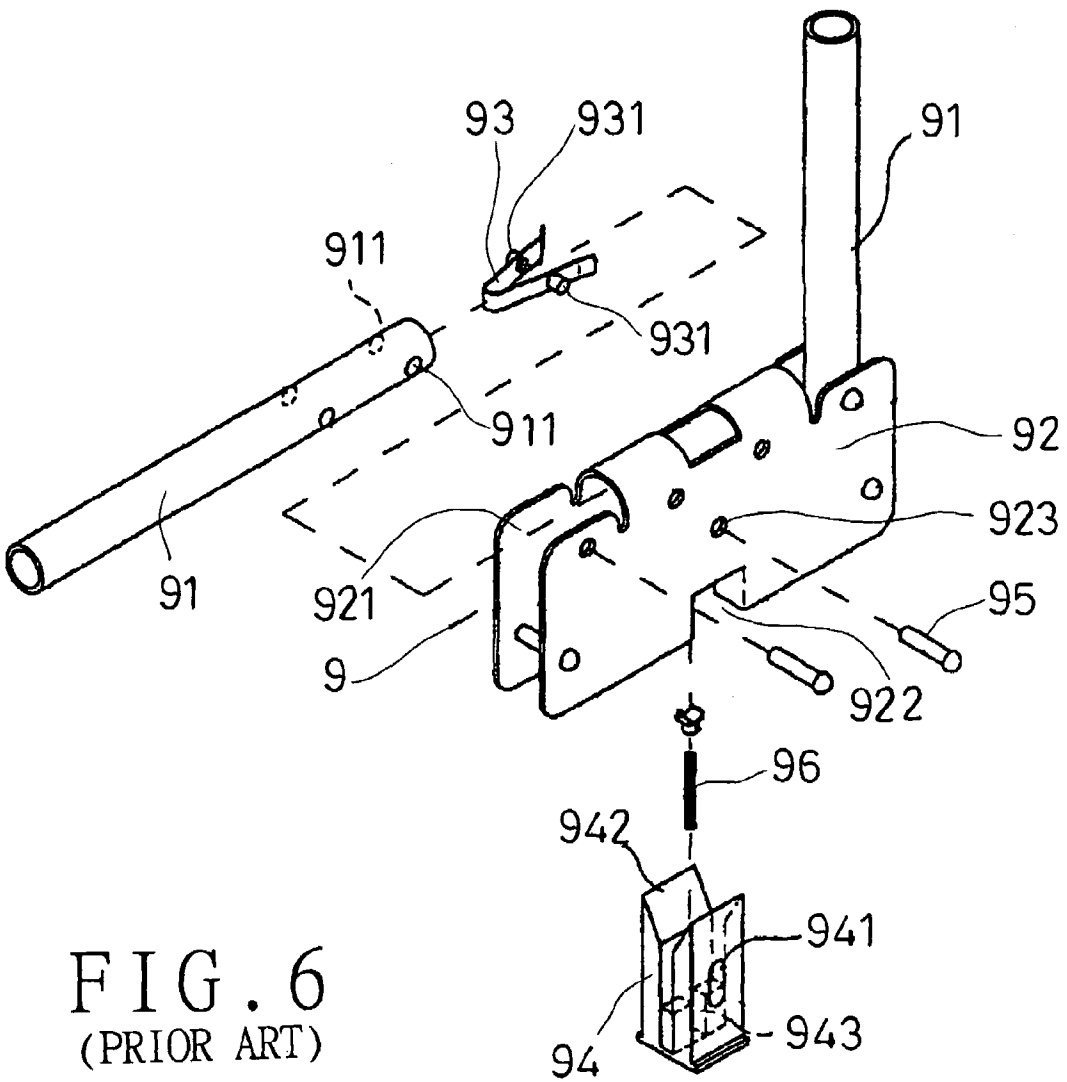
FIG. 6 (PRIOR ART)
FIG. 6 is an exploded perspective view of the prior art.

After the pressing member 4 is pressed so as to move to an upper position, the inner side of the pressing member 4 will press and angularly displace the stopping members 5 so as to make the free upper ends of the stopping members 5 close to each other, as shown in FIG. 3. And, the stopping members 5 will get away from and no longer stop the connecting rods 2 from pivoting to the upright stored position after the pressing member 4 is pressed to move to an upper position. Therefore, after the pressing member 4 is pressed to move to an upper position, pivotal motion of the connecting rods 2 to the upright position is allowed, and one of the connecting rods 2 will get into contact with the corresponding protruding portion 45 on one side of the pressing member 4 during its pivotal motion, thus making the pressing member 4 and the stopping members 5 tilt to one side with the pivotal rod 51 being displaced to tail ends of the curved guide slots 32, as shown in FIG. 4. Consequently, the other one of the stopping members 5 is further away from the inward end of the corresponding connecting rod 2; thus, the other one of the stopping members 5 can't possibly hinder the pivotal motion of the corresponding connecting rod 2. In other words, the baby bed can be smoothly folded without undesirable locking of one of the connecting rods 2.

Furthermore, the connecting rods 2 each have a sloping side for contacting the corresponding stopping member 5, which sloping side can be formed on an extending bar 21 secured to the inward end of the connecting rod 2. And, the extending bars 21 each have a concavity 22 on the sloping side thereof while each of the stopping members 5 has a protruding portion 53, which will fit in the concavity 22 when the connecting rods 2 are in the horizontal in-use position. Therefore, with the protruding portions 53 of the stopping members 5 fitting in the concavities 22 of the extending bars 21, the baby bed will be prevented from accidentally folding owing to vibration or people hitting the pressing member 4. Or alternatively, the stopping members 5 can be formed with concavities, and the sloping sides of the extending bars 21 can be formed with protruding portions.

From the above description, it can be seen that in order to be able to succeed in pivoting both the connecting rods to the substantially upright position to fold the baby bed, the user only has to press the pressing member one time, not having to keep pressing the pressing member or press the pressing member twice.

What is claimed is:

1. An improvement on a moving joint structure of a folding baby bed with meshes, pivotally connected to two connecting rods of a folding baby bed at two ends thereof and comprising:

a main support part, the main support part having two opposed lateral plates, a holding space between the lateral plates, and a curved guide slot on each of the lateral plates;

a pressing member positioned in the holding space of the main support part and connected to the main support part to be movable to and fro, the pressing member having a holding room therein and a protruding portion on each of two lateral sides thereof that face in opposing directions, the connecting rods can come into contact with the protruding portions of the pressing member when the connecting rods are angularly displaced to cause pivotal motion of the pressing member; and two stopping members, the stopping members together being pivoted to a pivotal rod to form a V shape together; the pivotal rod being passed through the curved guide slots of the lateral plates of the main support part at two ends thereof; the stopping members being subjected to an elastic position-restoring force; the pressing member can receive the stopping members in the holding room thereof, and press and angularly displace the stopping members so as to make free ends of the stopping members move close to each other when the pressing member is pressed while the connecting rods are propped on respective ones of the stopping members; the stopping members together can tilt to one side with the pivotal rod thereof being displaced along the curved guide slots upon pivotal motion of the pressing member.

2. The improvement on a moving joint structure of a folding baby bed with meshes as recited in claim 1, wherein the connecting rods each have a sloping side for contacting a corresponding stopping member, and the connecting rods have a plurality of concavities on the sloping sides, and the stopping members have a plurality of protruding portions for fitting in the concavities.

3. The improvement on a moving joint structure of a folding baby bed with meshes as recited in claim 1, wherein an elastic element is positioned between free ends of the stopping members.

4. The improvement on a moving joint structure of a folding baby bed with meshes as recited in claim 1, wherein the pressing member has a slot, and a fixed pin is passed through the slot of the pressing member and secured to the main support part, and a restoring spring touches the fixed pin and the pressing member at two ends thereof for exerting force on the pressing member.

5. The improvement on a moving joint structure of a folding baby bed with meshes as recited in claim 1, wherein each of the protruding portions includes a plurality of protruding blocks.

* * * * *